US006033060A

United States Patent [19]

Minami

[11] Patent Number: 6,033,060

[45] Date of Patent: Mar. 7, 2000

[54] MULTI-CHANNEL INK SUPPLY PUMP

[75] Inventor: Don S. Minami, Monte Sereno, Calif.

[73] Assignee: Topaz Technologies, Inc., Sunnyvale, Calif.

[21] Appl. No.: 08/920,677

[22] Filed: Aug. 29, 1997

[51] Int. Cl.[7] ..... B41J 2/175

[52] U.S. Cl. ..... 347/85; 347/35; 417/477.11

[58] Field of Search ..... 347/84, 85, 35; 417/412, 475, 477.3, 477.12, 477.11

[56] References Cited

U.S. PATENT DOCUMENTS

| | | | |
|---|---|---|---|
| 3,723,030 | 3/1973 | Gelfand | 417/475 |
| 3,822,948 | 7/1974 | Handl | 417/412 |
| 4,333,088 | 6/1982 | Diggins | 347/35 |
| 4,432,005 | 2/1984 | Duffield et al. | 347/86 |

FOREIGN PATENT DOCUMENTS

| | | | |
|---|---|---|---|
| 0 671 274 A1 | 9/1995 | European Pat. Off. | B41J 2/165 |
| 3333 626 A1 | 4/1985 | Germany | B41J 3/04 |
| 60-002367 | 1/1985 | Japan . | |

*Primary Examiner*—N. Le
*Assistant Examiner*—Judy Nguyen
*Attorney, Agent, or Firm*—Lyon & Lyon LLP

[57] ABSTRACT

A multi-channel ink supply pump includes a pump shaft with four associated rollers and a cam shaft with four cams evenly spaced longitudinally along the cam shaft. Four tube pinching arms are each hinged at one end to a fixed point. The free ends of the tube pinching arms are spring-biased toward the pump shaft. A first motor is configured through gears to rotate the pump shaft. A second motor is configured through gears to rotate the cam shaft. The pump shaft and the cam shaft are not simultaneously rotated. Tubes carrying ink run underneath the pump shaft and rollers, between the rollers and the tube pinching arms. The cam shaft is normally positioned to counteract the spring bias in all of the tube pinching arms, retracting all of the tube pinching arms away from the pump shaft. The cams are individually oriented to different positions so that one full rotation of the cam shaft counteracts the spring bias for three of the four tube pinching arms at any given time, allowing each tube pinching arm in succession to temporarily rotate toward the pump shaft. In addition all four tube pinching arms are simultaneously allowed to temporarily rotate toward the pump shaft during the one full rotation of the cam shaft.

3 Claims, 5 Drawing Sheets

MULTI-CHANNEL INK SUPPLY PUMP

BACKGROUND OF THE INVENTION

1. Field of the Invention

The present invention pertains generally to the field of ink jet printers, and more particularly to ink supply pumps for ink jet printers.

2. Background

Ink jet printers, which today generally use multiple channels to print with several colors of ink, are manufactured with pumps to prime the ink supply plumbing in the printer system, maintain the free flow of ink to the print heads, and purge the ink supply lines. Each color of ink has its own channel. A channel comprises a print head, or heads, and ink supply lines for the head, or heads. Pumping is the process of supplying ink to the print heads. Purging is the process of clearing the print heads of excess accumulated ink and debris. Priming is the process of preparing the ink supply plumbing to permit the free flow of ink to the print heads. Priming the ink supply plumbing is accomplished by filling ink supply lines and ink reservoir in the print heads. Purging of the print heads and ink supply lines is done periodically during a printer's use to purge the print heads of excess ink, debris, and air bubbles.

Conventionally, ink jet printers leave all channels open, i.e., ink can flow freely through each channel. In conventional ink jet printers, each print head is purged at the same time and purging of the print heads is accomplished through suction. In other words, ink or other purging fluid is drawn through the heads from the ink ejection side of the print head. It would be advantageous to provide the capability of either purging, pumping, or priming individual channels selectively or purging, pumping, or priming individual channels all at once. It would also be advantageous to purge, pump or prime with the same apparatus. Thus, there is a need for a pump that can selectively pump or prime any one, or all, channels of an ink jet printer and selectively deliver a pressure pulse to purge an ink jet nozzle of any one, or all, channels of an ink jet printer.

SUMMARY OF THE INVENTION

The present invention is directed to an apparatus that can selectively pump or prime any one, or all, channels of an ink jet printer and selectively deliver a pressure pulse to purge an ink jet nozzle of any one, or all, channels of an ink jet printer. Accordingly, a multi-channel ink supply pump has first and second motors, a pump shaft with associated rollers, tube pinching arms, and a cam shaft with cams evenly spaced along its length. The pump shaft can preferably be rotated by the first motor. The tube pinching arms are advantageously each hinged at one end to a fixed point and biased at the other end toward the pump shaft. Preferably, the cam shaft can be rotated by the second motor and is advantageously positioned to counteract the biasing force on each of the tube pinching arms, simultaneously retracting all of the tube pinching arms away from the pump shaft.

In a first aspect of the invention, the ink supply lines in a printer can advantageously be primed either simultaneously or one at a time. The cam shaft can preferably rotated to counteract the biasing force on all but one of the tube pinching arms, successively allowing each tube pinching arm to temporarily succumb to the biasing force and rotate toward the pump shaft. Advantageously, rotation of the cam shaft can also simultaneously allow each of the tube pinching arms to succumb to the biasing force and rotate toward the pump shaft.

In a second, separate aspect of the invention, print heads in a printer can be purged with pressurized ink. The cam shaft can preferably be rotated to cause ink-carrying tubes to blow small amounts of ink into the print heads of the printer to purge the print heads of excess ink or debris. Advantageously, purging can be accomplished either for all of the ink-carrying tubes at once, or for each tube individually, one tube at a time.

DETAILED DESCRIPTION OF THE PREFERRED EMBODIMENTS

Figure 1:
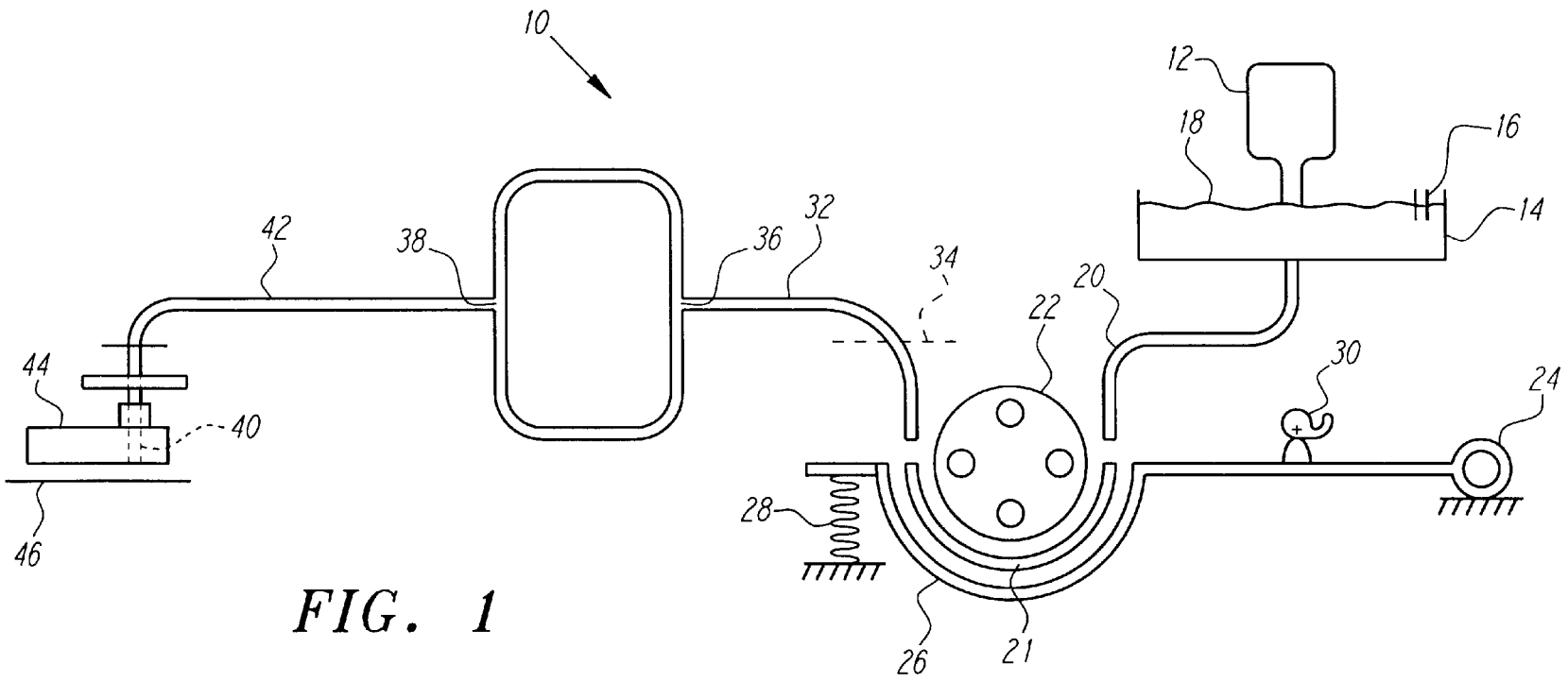
FIG. 1 is a free-body side view of an ink jet printer system.

In FIG. 1, a schematic of one channel of a representative ink jet printer system 10 is shown. The channel of the ink jet printer system 10 includes one or more ink bottles 12 positioned to drain ink into one or more ink containers 14. Preferably, four channels are used, each carrying a different color of ink, thereby necessitating the use of four ink bottles 12 and four associated ink containers 14. In a particular embodiment, these colors are black, cyan, magenta, and yellow. An ink-level sensor 16 senses the ink level 18 in the ink container 14, which drops as ink flows downward through an ink tube 20 to a pump-shaft-and-rollers mechanism 22 that is driven by a first motor (not shown in FIG. 1). The ink flows through a tube 21 under the pump-shaft-and-rollers mechanism 22.

A second motor (also not shown in FIG. 1) controls the position of one or more tube pinching arms 26 by turning a cam shaft 30. In a preferred embodiment, there are four such tube pinching arms 26, one for each channel. Each tube pinching arm 26 is biased by spring loading one end with a spring 28 and rotationally hinged at an opposing end to a fixed shaft 24. Each tube pinching arm 26 can be retracted by the cam shaft 30 that is driven by the second motor. Thus, as described in detail below, the second motor rotates the cam shaft 30 to retract the tube pinching arm 26, and the first motor rotates a pump shaft within the pump-shaft-and-rollers mechanism 22, but not both simultaneously.

When in the pumping mode, ink from any individual channel, or from all four channels, can be pumped upward through a tube 32. The pumping action is peristaltic, due to the configuration of the pump-shaft-and-rollers mechanism 22, such that the ink is pumped in spurts to pass above the level (shown by dotted line as 34) beyond which the force of gravity would restrict it from rising. (In other words, prior to pumping, the ink will reach the level 34.) First and second T connectors 36, 38 split the flow of ink, thereby reducing sloshing of the ink caused by motion of the print head 40. When rollers within the mechanism 22 are turning, as described further below, the ink flows through a second section 42 of the tube 32 to the print-head reservoir 44 of the print head 40. The print head 40 transmits the ink to the surface of a print medium 46. Typical print media include paper, plastic transparency, and other appropriate media.

Specifically, the print heads 40 are mounted on a carriage that laterally traverses a platen having a print medium 46 running therethrough. This lateral movement of the print heads 40 causes ink in the tube 42 and reservoir 44 to "slosh." Sloshing of the ink, while unavoidable, is also undesirable because it can result in pressure differences in the tubes, imprecise measurements of the ink levels by ink-level sensors (not shown) mounted in the reservoirs 44 on the heads 40, and a decrease in the amount of ink fed into the heads 40.

Figure 2:
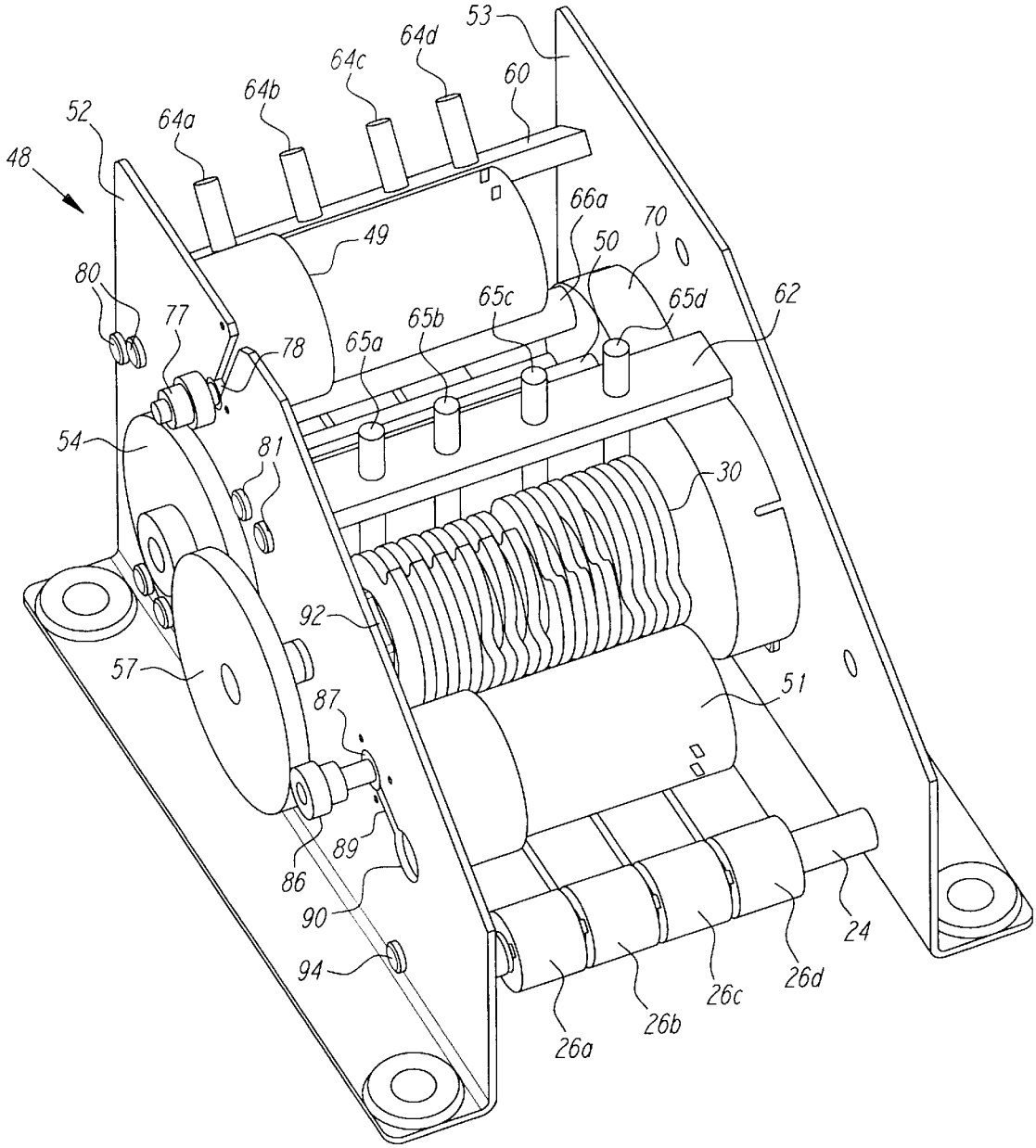
FIG. 2 is a perspective view of an ink supply pump that can be used in the ink jet printer system of FIG. 1.

As shown in FIG. 2, a representative ink supply pump 48 can be used in the printer system 10 to selectively enable any one of four individual ink-delivery channels. In FIG. 2, the four tube pinching arms 26*a*–26*d* are depicted in the retracted, or free-flow, position. Any one tube pinching arm 26*a*–26*d* may be moved to the spring-loaded, or tube pinching, position. The respective positions of the tube pinching arms 26*a*–26*d* are a function of the rotational position of the cam shaft 30.

Figure 3:
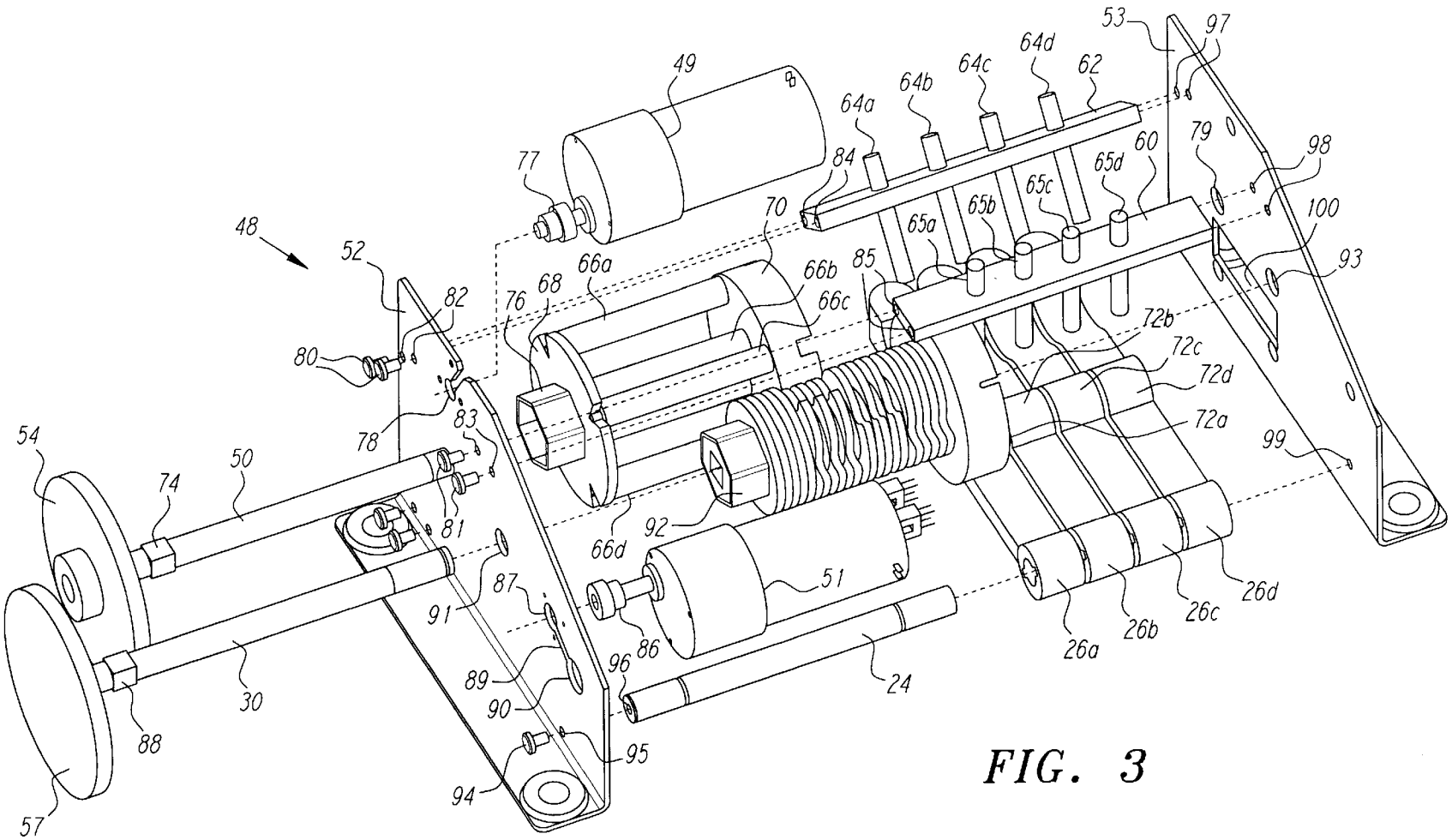
FIG. 3 is an exploded perspective view of the ink supply pump of FIG. 2.

As shown in FIGS. 2–3, the cam shaft 30 lies parallel to the first motor 49, a pump shaft 50, and the second motor 51. The cam shaft 30 is situated in between the second motor 51 and the pump shaft 50. The pump shaft 50 is situated between the cam shaft 30 and the first motor 49. The first motor 49, pump shaft 50, cam shaft 30, and second motor 51 are each generally cylindrical in shape and bounded at their respective ends by dual support brackets 52, 53 of the ink supply pump 48. First and second caps 54, 57 attach, respectively, to the pump shaft 50 and the cam shaft 30.

Figure 4A:
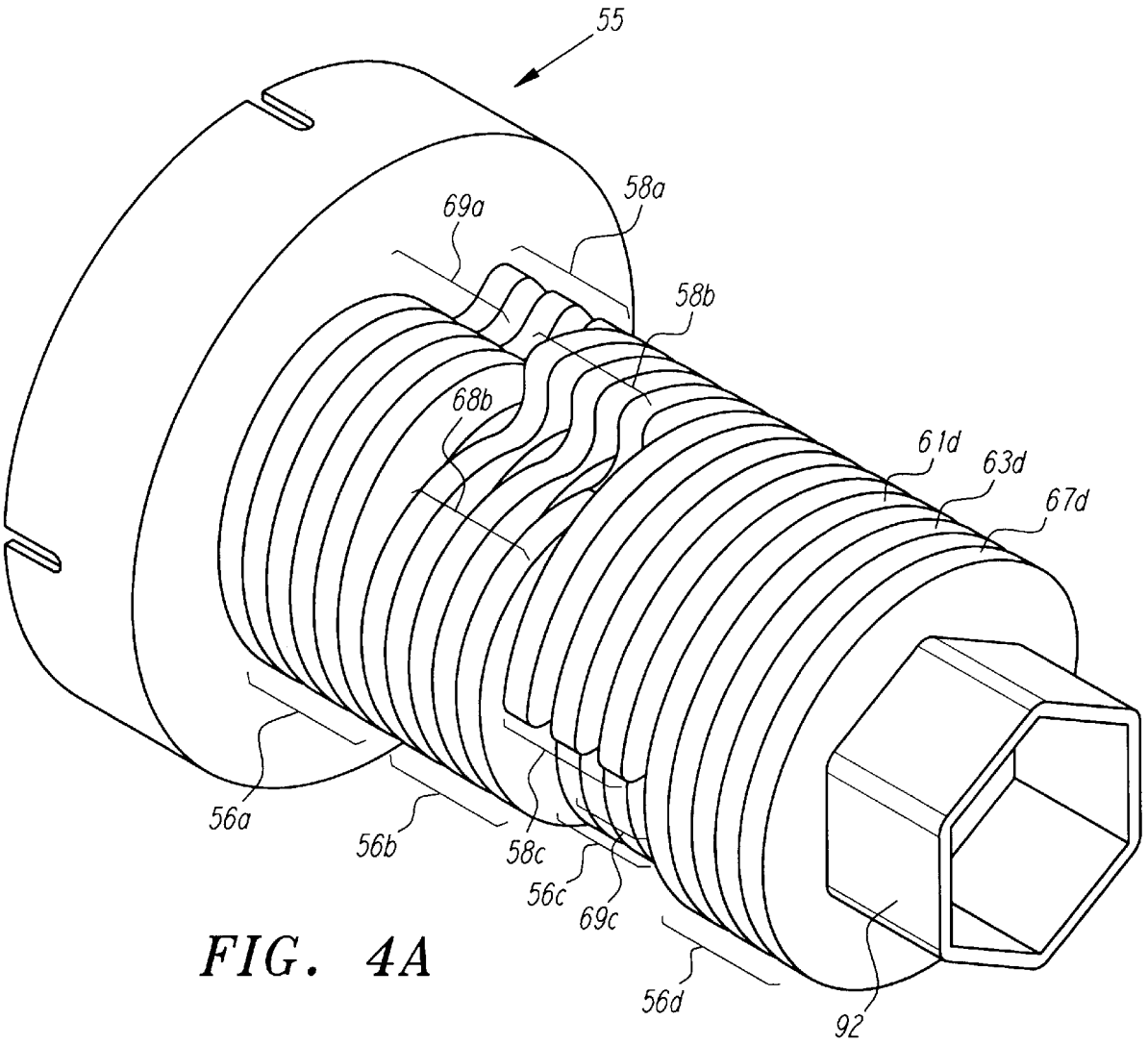
FIGS. 4A and 4B are perspective views of a cam unit that can be used in the ink supply pump of FIG. 2.
Figure 4B:
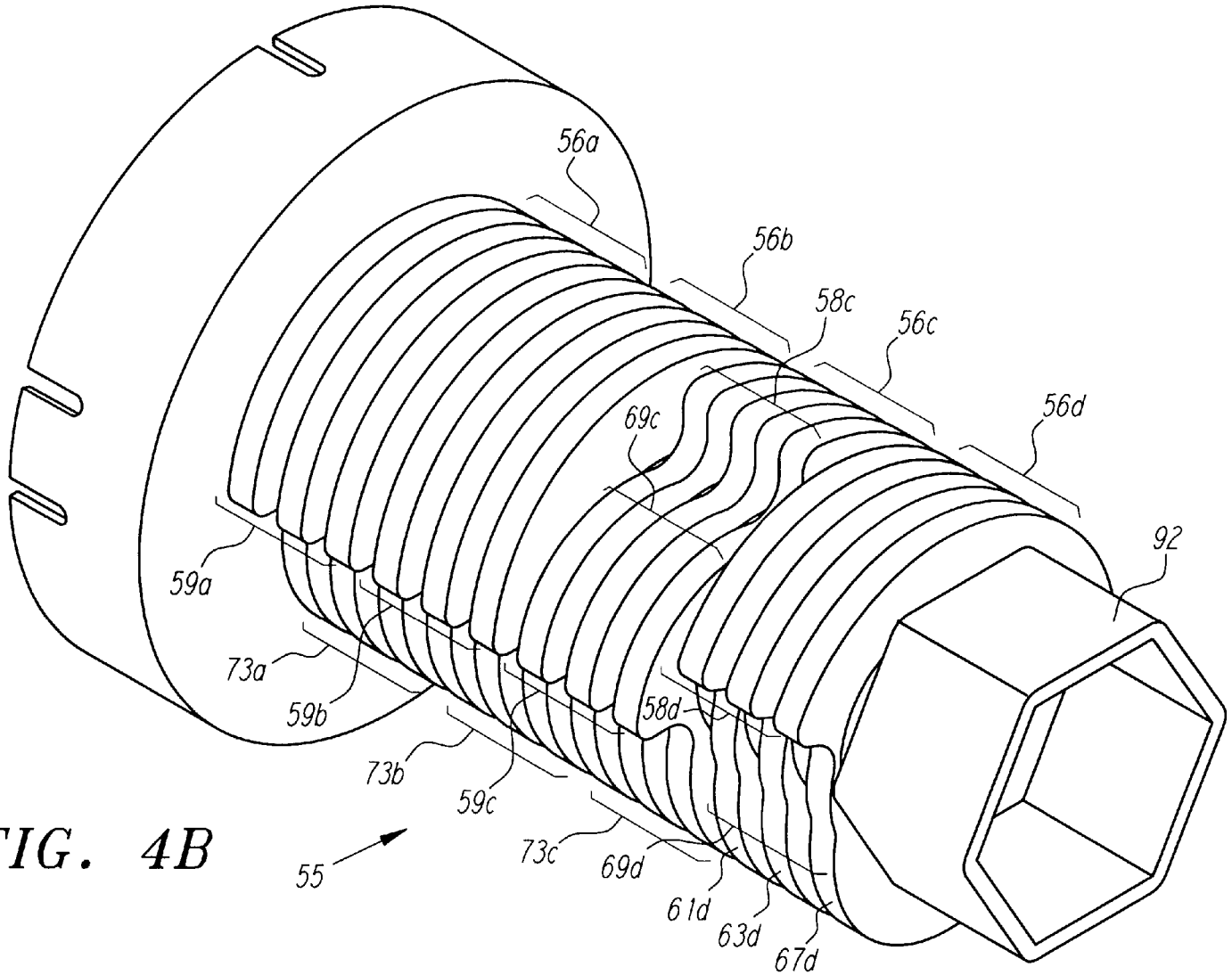

In a particular embodiment shown in FIGS. 4A–4B, the cam shaft (not shown) holds a cam unit 55 comprising four cams 56*a*, 56*b*, 56*c* and 56*d* evenly spaced along the longitudinal axis of the cam unit 55. One cam (i.e., one of cams 56*a*, 56*b*, 56*c* and 56*d* is used for each channel in the ink supply pump 48. Each cam 56*a*–56*d* comprises a plurality of adjacent, longitudinally spaced-apart cam disks 61, 63, 67 (for the purpose of making FIGS. 4*a* and 4*b* easy to read, cam disks 61, 63, 67 are only labeled for cam 56*d*; they are denoted by reference numerals 61*d*, 63*d*, and 67*d*). In the embodiment shown, each cam 56*a*–56*d* includes three cam disks 61, 63, 67.

Each cam 56*a*–56*d* comprises a first lobe 58*a*–58*d*. Thus, cam 56*a* includes a first lobe 58*a* that is positioned out of phase with first lobe 58*b* on cam 56*b*. In similar fashion, cams 56*c* and 56*d* have first lobes 58*c* and 58*d* that are each positioned out of phase with respect to each other and with respect to first lobes 58*a* and 58*b*. Cams 56*a*, 56*b* and 56*c* also include a second lobe 59*a*, 59*b* and 59*c*. The respective second lobes 59*a*, 59*b* and 59*c* are situated on the cams 56*a*, 56*b* and 56*c* so as to be in phase with one another. Each first lobe 58*a*, 58*b*, 58*c* and 58*d* is followed by a first cam surface 69*a*, 69*a*, 69*c* and 69*d* and each second lobe 59*a*, 59*b*, and 59*c* is followed by a second cam surface 73*a*, 73*b* and 73*c*. The first cam surface 69*d* following first lobe 58*d* on fourth cam 56*d* is delayed so as to be in phase with the second cam surfaces 73*a*, 73*b* and 73*c* following second lobes 59*a*, 59*b* and 59*c*.

In a preferred embodiment, the cam unit 55 is manufactured by injection molding a one-piece unit 55. Advantageously, three cam disks 61, 63, 67 embody each cam 56*a*–56*d*, thereby serving to enhance manufacturing throughput by shortening drying time.

As shown in FIGS. 2–3, first and second supports 60, 62 include four pairs of open-ended, cylindrical protrusions 64*a*, 64*b*, 64*c* and 64*d* and 65*a*, 65*b*, 65*c* and 65*d* through which ink-carrying tubes (not shown) are threaded or press fit thereon. Four rollers 66*a*, 66*b*, 66*c* and 66*d* (FIG. 3) lie parallel to the pump shaft 50, such that the pump shaft 50 is centrally located, with the rollers 66*a*, 66*b*, 66*c* and 66*d* surrounding the pump shaft 50. The pump shaft 50 and the rollers 66*a*, 66*b*, 66*c* and 66*d* are rotatably connected to first and second opposing circular ends 68, 70. Rotation of the pump shaft 50 causes similar rotation of the rollers 66*a*, 66*b*, 66*c* and 66*d*. As can be seen, the rollers 66*a*, 66*b*, 66*c* and 66*d* surround the pump shaft 50 so that the ends of the rollers 66*a*, 66*b*, 66*c* and 66*d* lie at four corners of an imaginary square having the end of the pump shaft 50 at its center.

The tube pinching arms 26*a*, 26*b*, 26*c* and 26*d* are rotatably mounted at one end to the fixed shaft 24. The tube pinching arms 26*a*, 26*b*, 26*c* and 26*d* are depicted in the retracted, or free-flow, position. The tube pinching arms 26*a*, 26*b*, 26*c* and 26*d* are retracted when the cam shaft 30 is rotated to an angular position in which either the first cam surfaces 69*a*, 69*a* and 69*c* or the second cam surfaces 73*a*, 73*b* and 73*c* of cams 56*a*, 56*b* and 56*c*, and the first cam surface 58*d* of cam 56*d*, each engage respective tabs 72*a*, 72*b*, 72*c* and 72*d* protruding upward from the respective-tube pinching arms 26*a*, 26*b*, 26*c* and 26*d*. The cams 56*a*, 56*b*, 56*c* and 56*d* push against the respective tabs 72*a*, 72*b*, 72*c* and 72*d* with sufficient force to overcome the rotary spring bias (not shown in FIGS. 2–3) and urge the tube pinching arms 26*a*, 26*b*, 26*c* and 26*d* upward.

Any one of the respective tube pinching arms 26*a*, 26*b*, 26*c* and 26*d*, such as, e.g., tube pinching arm 26*a*, can be released to the spring-loaded, or tube-pinching, position by rotating the cam shaft 30 to a position in which the tab 72*a* on the tube pinching arm 26*a* slips over the first lobe 58*a* of the cam 56*a* and engages the first cam surface 69*a*. This would allow the tube pinching arm 26*a* to rotate upward, as urged by the spring bias, and cause a tube carrying ink to be pinched against two of the rollers 66*a*, 66*b*, 66*c* and 66*d* by the tube pinching arm 26*a*.

Similarly, tube pinching arm 26*b* can be released to the tube-pinching position by further rotating the cam shaft 30 to a position in which the tab 72*b* on tube pinching arm 26*b* slips over the first lobe 58*b* of the cam 56*b* and engages the first cam surface 69*a*. The tube pinching arm 26*b* would then rotate upward to pinch a tube against two of the rollers 66*a*, 66*b*, 66*c* and 66*d*. Tube pinching arm 26*c* is released to the tube-pinching position by further rotating the cam shaft 30 to a position in which the tab 72*c* on tube pinching arm 26*c* slips over the first lobe 58*c* of the cam 56*c* and engages the first cam surface 69*c*. The tube pinching arm 26*c* then rotates upward to pinch a tube against two of the rollers 66*a*, 66*b*, 66*c* and 66*d*. Tube pinching arm 26*d* can be rotated upward to the tube-pinching position by further rotating the cam shaft 30 to a position in which the tab 72*d* on tube pinching arm 26*d* slips over the first lobe 58*d* of the cam 56*d* and engages the first cam surface 69*d*, which frees the tube pinching arm 26*d* to rotate upward and pinch a tube against two of the rollers 66*a*, 66*b*, 66*c* and 66*d*.

Alternatively, all four tube pinching arms 26*a*, 26*b*, 26*c* and 26*d* can be "pinched" to the tube-pinching position simultaneously by rotating the cam shaft 30 even further to a position in which the first lobe 58*d* on cam 56*d* has slipped over the tab 72*d* on tube pinching arm 26*d* and has continued to engage the first cam surface 69*d* on cam 56*d* until the second lobes 59*a*, 59*b*, and 59*c* on cams 56*a*, 56*b* and 56*c* slip over the respective tabs 72*a*, 72*b* and 72*c* on the tube pinching arms 26*a*, 26*b* and 26*c* and engage, respectively, the second cam surfaces 73*a*, 73*b* and 73*c*. This would allow the tube pinching arms 26*a*, 26*b*, 26*c* and 26*d* to rotate upward simultaneously, as urged by the spring bias, and cause all four tubes carrying ink to be pinched against two of the rollers 66*a*, 66*b*, 66*c* and 66*d* by the tube pinching arms 26*a*, 26*b*, 26*c* and 26*d*.

In a particular embodiment, the various component parts of the ink supply pump 48 fit together as shown in FIG. 3. The first motor 49 includes a gear 77 protruding therefrom, which serves to mount the first motor 49 to the support bracket 52 via a slot 78, such that the support bracket 52 is disposed between the gear 77 and the first motor 49. The pump shaft 50 preferably includes a cap 54 mounted to a hexagonally configured end 74. The cap 54 is situated so as to be engaged by the gear 77, which is rotated by the first motor 49, causing the pump shaft 50 to rotate in turn.

The pump shaft 50 inserts through an opening 75 in the support bracket 52 into a mechanism (denoted 22 in FIG. 1) that includes the rollers 66*a*, 66*b*, 66*c* and 66*d*. The rollers mechanism 22 is positioned adjacent the first motor 49 so that the rollers 66*a*, 66*b*, 66*c* and 66*d* are generally parallel to an axis of the first motor 49. The hexagonally configured end 74 of the pump shaft 50 mates with the interior of a hexagonal socket 76 mounted to an end 68 of the rollers mechanism 22. The pump shaft 50 runs through an end 70 of the rollers mechanism 22 and is attached to the support bracket 53 via an opening 79 in the support bracket 53.

The pump shaft 50 and rollers mechanism 22 are disposed above the respective tube pinching arms 26*a*, 26*b*, 26*c* and 26*d* and between the cylindrical protrusions 64*a*, 64*b*, 64*c* and 64*d* and 65*a*, 65*b*, 65*c* and 65*d*. The first and second supports 60, 62, through which the cylindrical protrusions 64*a*, 64*b*, 64*c* and 64*d* and 65*a*, 65*b*, 65*c* and 65*d* run, respectively, are located above and on opposing sides of the pump shaft 50 and rollers mechanism 22. The first and second supports 60, 62 are secured to the support bracket 52 with, respectively, first and second pairs of bolts 80, 81 inserted through first and second openings 82, 83 in the support bracket 52 into dual apertures 84, 85 in first ends of the first and second supports 60, 62. The first and second supports 52, 53 are similarly affixed at second ends to the support bracket 53 via first and second dual openings 97, 98, respectively, defined in the support bracket 53.

The second motor 51 includes a gear 86 protruding therefrom, which serves to mount the second motor 51 to the support bracket 52 via an opening 87, such that the support bracket 52 is disposed between the gear 86 and the second motor 51. The cam shaft 30 includes a cap 57 mounted to a hexagonally configured end 88. The cap 57 is situated so as to be engaged by the gear 86, which is rotated by the second motor 51, causing the cam shaft 30 to rotate in turn. The second motor 51 can be moved so that the gear 86 is disengaged from the cap 57. This is possible because the opening 87 through which the gear 86 fits is connected by a slot 89 in the support bracket 52 to a second opening 90 in the support bracket 52.

The cam shaft 30 inserts through an opening 91 in the support bracket 52 into the cam unit (denoted 55 in FIGS. 4A–4B). The cam unit 55 is positioned adjacent the second motor 51 so that the cam shaft 30 is generally parallel to an axis of the second motor 51. The cam unit 55 is disposed between the second motor 51 and the cylindrical protrusions 65*a*, 65*b*, 65*c* and 65*d*. The cylindrical protrusions 65*a*, 65*b*, 65*c* and 65*d* are likewise disposed between the cam unit 55 and the rollers mechanism 22. The hexagonally configured end 88 of the cam shaft 30 mates with the interior of a hexagonal socket portion 92 of the cam unit, which is located at an end of the cam unit 55. The cam shaft 30 runs through the cam unit 55 and is attached to the support bracket 53 via an opening 93 in the support bracket 53.

The fixed shaft 24 inserts through ends of the respective tube pinching arms 26*a*, 26*b*, 26*c* and 26*d* and lies below and to one side of the second motor 51 and generally parallel to an axis of the second motor 51. The fixed shaft 24 is attached to the support bracket 52 with a bolt 94 that inserts through an opening 95 in the support bracket 52 into an aperture 96 defined in a first end of the fixed shaft 24. The fixed shaft 24 is similarly affixed to the support bracket 53 at a second end via an opening 99 defined in the support bracket 53.

In one embodiment, the ink supply pump 48 is 140 millimeters (mm) wide, 190 mm long, and 100 mm high. The tubing (not shown), which fits into cylindrical protrusions 64*a*, 64*b*, 64*c* and 64*d* and 65*a*, 65*b*, 65*c* and 65*d*, is 4.8 mm in diameter, has a wall-thickness of 0.81 mm, and is made from a flexible material such as TYGON b44-4. The ink-delivery rate per channel when only one channel is pumping is forty-six milliliters (ml) per minute. With all channels pumping, the ink-delivery rate is thirty-eight ml per minute. The cam shaft 30 can be sequenced through one full operational cycle in 2.3 seconds. The ink supply pump 48 can be equipped with two sensors (not shown), which are preferably transmissive LED-photodetector pairs.

In a specific embodiment, the first and second motors 49, 51 are PITTMAN GM9434 motors with twenty-four-volt windings and side terminals. The motors 49, 51 each include 218.42 gear ratio with a wide-face gear option providing 500 inch-ounces of torque capacity. The motors 49, 51 can each advantageously achieve a no-load speed of 28.2 rotations per minute (rpm). The torque constant for the motors 49, 51 is 5.17 inch-ounces per amp, and the back electromotive force (EMF) constant is 3.82 volts per kilorpm. The motors 49, 51 have terminal resistances of 2.96 ohms, inductances of 2.51 milliHenries, no-load currents of 0.16 amps, and peak (stall) currents of 8.11 amps.

In operation the preferred ink supply pump 48 functions as a four-channel, peristaltic pumping device. The spring-loaded tube pinching arm 26 associated with each ink channel can be retracted by the cam shaft 30. Thus, the cam shaft 30 holds the cam unit 55, which controls the state of the ink supply pump 48, i.e., the cam unit 55 dictates which tube pinching arm 26 is retracted.

As discussed above, each cam 56*a*, 56*b*, 56*c* and 56*d* is fixedly attached, by way of the cam unit 55, to the cam shaft 30 at a different angular orientation from the remaining cams 56*a*, 56*b*, 56*c* and 56*d*. Thus, each respective first lobe 58*a*, 58*b*, 58*c* and 58*d* is out of phase with the first lobes 58*a*, 58*b*, 58*c* and 58*d* of the remaining cams 56*a*, 56*b*, 56*c* and 56*d* and each respective first cam surface 69*a*, 69*a*, 69*c* and 69*d* is out of phase with the remaining first cam surfaces 69*a*, 69*a*, 69*c* and 69*d*, but the respective second lobes 59*a*, 59*b*, and 59*c* are all in phase with one another, and the respective second cam surfaces 73*a*, 73*b* and 73*c* following the second lobes 59*a*, 59*b*, and 59*c* and the first cam surface 69*d* following the first lobe 58*d* are in phase with one another.

In a preferred embodiment, the cam shaft 30 can be rotated through six positions, permitting the following six states: (1) free flow; (2)–(5) pump one channel; and (6) pump all channels. In the first state, the cam shaft 30 is rotationally positioned such that all four tube pinching arms 26*a*, 26*b*, 26*c* and 26*d* are retracted, i.e., so that neither the first lobes 58*a*, 58*b*, 58*c* and 58*d* nor the second lobes 59*a*, 59*b* and 59*c* have slipped over the respective tabs 72*a*, 72*b*, 72*c* and 72*d* on the tube pinching arms 26*a*, 26*b*, 26*c* and 26*d*. "Free flow" is the normal state of the ink supply pump 48, in which ink flows freely through all four channels without restriction. In the four "pump one channel" states, one of four channels is independently pinched, restricting ink flow in that channel, i.e., the cam shaft 30 is rotated until one of the first lobes 58*a*, 58*b*, 58*c* and 58*d* slips over a respective tab 72*a*, 72*b*, 72*c*, and 72*d*. In the "pump all channels" state, all four channels are pinched simultaneously, restricting ink flow in all of the channels, i.e., the cam shaft 30 is rotated until the first lobe 58*d* slips over the tab 72*d* and then the three second lobes 59*a*, 59*b* and 59*c* each slip over the respective tabs 72*a*, 72*b* and 72*c*.

The ink supply pump 48 is powered by the first and second motors 49, 51 which are coupled by gears 77, 86 to, respectively, the pump shaft 50 and the cam shaft 30. When the first motor 49 is driven, the pump shaft 50 rotates and the cam shaft 30 idles. When the second motor 51 is driven, the cam shaft 30 rotates and the pump shaft 50 idles. The first and second motors 49, 51 are not driven simultaneously, and the second motor 51 can be disengaged from operative contact with the cam shaft 30.

In a particular embodiment, two sensors (not shown) can be attached to monitor the state of the ink supply pump 48. Preferably, one sensor detects the angular position of the cam shaft 30, and the other sensor detects the angular position of the pump shaft 50. The sensors are advantageously fine tuned to detect relatively small degrees of movement between the various angular positions that the cam shaft 30 and the pump shaft 50 can achieve. Preferably, the sensors are attached to the support bracket 53 (see FIG. 3) and can access the cam shaft 30 and the pump shaft 50 via a rectangular opening 100 defined in the support bracket 53.

In the normal operating mode, all ink channels are in the free-flow condition. Thus, the cam shaft 30 is positioned to free flow, and the first motor 49 is off. The pump shaft 50 is situated in a "park" position and is not moving. Both sensors are on and detect no motion. At start-up, all four channels are open, i.e., in the free-flow state. When in the free-flow state, the ink flows through the tubes until it reaches the level 34 shown in FIG. 1, and not beyond. This is because fluids such as ink "seek their own level." In a specific embodiment of an ink jet printer, the pump 48 will be located below the ink container 14 (see FIG. 1).

In the priming mode of operation, the ink supply pump 48 is used to fill the supply line and the print-head reservoir 44 (which is integral with the print head 40) with ink (see FIG. 1). Thus, prior to pumping, the pump 48 is in the free-flow state, which allows the ink to flow to the level 34 of FIG. 1. However, before printing can begin, ink must be received by the reservoir 44. Thus, the pump 48 will "prime" the line, i.e., get ink from the level 34 to the reservoir 44. The first step in the priming mode is to place the pump 48 in the "pump all channels" state, as described above. Once all of the tube pinching arms 26*a*, 26*b*, 26*c* and 26*d* have pinched off the tubes, the first motor 49 is driven to begin turning the pump shaft 50 and its associated rollers 66*a*, 66*b*, 66*c* and 66*d*, thereby squeezing pressure waves through the tubes. The rollers 66*a*, 66*b*, 66*c* and 66*d* pass over the tubes one after the other, which results in peristaltic pumping action. The rollers 66*a*, 66*b*, 66*c* and 66*d* squeeze ink to the print head 40 via the peristaltic pumping action. When this is happening, the pump shaft 50 sensor detects rotation, alternating on and off. The cam shaft 30 sensor detects no motion.

When any one of four ink-level sensors 16 (see FIG. 1) detects ink, one of the channels is "full," i.e., ink has been squeezed to the print head 40 and detected in the print-head reservoir 44. Pumping action must therefore be stopped. The channel that has "filled" before the other three channels has its identity flagged, preferably in connection with a computer (not shown) software value, and the identities of the empty channels are determined, so that the cam shaft 30 can be rotated to select each channel that still needs to have ink pumped therethrough. Thus, the first motor 49 is turned off, and the second motor 51 is enabled, thereby disengaging the pump shaft 50 and engaging the cam shaft 30 to rotate the cam shaft 30 into position to pinch an empty channel. The pump shaft 50 sensor thus detects no motion, and the cam shaft 30 sensor detects rotation, alternating on and off. The first motor 49 is then reenabled, engaging the pump shaft 50, the cam shaft 30 is left in the pinch position for the channel, etc. The process continues until all level sensors 16 detect ink. When all level sensors 16 detect ink, and the pump 48 returns to the normal operating state, with all channels open. Once the lines are primed, the heads 40 can provide all the pressure needed to draw ink from the ink bottle 12, through the tubes 20, 21, 32, and into the reservoir 44 (see FIG. 1).

In the purging mode, the ink supply pump 48 is used to clear the ink channels of the print heads 40 with small bursts of ink. The cam shaft 30 and the pump shaft 50 are alternately rotated to drive the pump 48 through the six states which delivering small bursts of ink through each channel. Starting from the free-flow state, the cam shaft 30 is rotated into the first pump-one-channel state. The first motor 49 is enabled to drive the pump shaft 50 for a brief, predetermined period of time preferably tens of milliseconds long. This causes the rollers 66*a*, 66*b*, 66*c* and 66*d* to pass over the tube 21 (see FIG. 1). The volume of ink delivered is determined by the duration of this period. This process is repeated for each channel for which a purge is necessary, with the cam shaft 30 being rotated through up to all four pump-one-channel positions, i.e., through up to one complete rotation of the cam shaft 30. For each tube, the tab 72 on the respective tube pinching arm 26 strikes the tube with a thumping action such that the pressure blows ink, debris, or air bubbles out of the print heads 40. Unless a "super purge" is desired, the pump shaft 50 is not rotated when the pump 48 is in the pump-all-channels state. After the four channels have been purged, the cam shaft 30 is returned to the free-flow state.

In a presently preferred embodiment the ink supply pump 48 has four channels. Nevertheless, it is to be understood that the number of channels need neither be limited to nor held below four.

Preferred embodiments of the present invention have thus been shown and described. It would be apparent to one of ordinary skill in the art, however, that numerous alterations may be made to the embodiments herein disclosed without departing from the spirit or scope of the invention. Therefore, the invention is not to be limited except in accordance with the following claims.

What is claimed is:

1. An ink supply pump for use in an ink jet printer, comprising:

first and second motors;

a pump shaft rotatably driven by the first motor;

four rollers oriented substantially parallel to the pump shaft and evenly spaced to surround the pump shaft, the rollers configured to move with rotation of the pump shaft;

four tube pinching arms, each hingedly attached at a first end to a fixed point, the tube pinching arms including protruding tabs;

four coil springs, each biasing a respective second end of each of the tube pinching arms toward the pump shaft;

four ink-carrying tubes lying, respectively, between each of the four tube pinching arms and the pump shaft; and a cam shaft rotatably driven by the second motor, the cam shaft including four cams evenly spaced along the length of the cam shaft, the four cams each including first lobes, three of the four cams including second lobes, each of the respective first lobes being situated out of phase with the other three of the first lobes, the cam shaft being positioned to simultaneously counteract the spring-bias force on each of the four tube pinching arms, thereby retracting the four tube pinching arms away from the pump shaft.

2. The ink supply pump of claim 1, wherein rotation of the cam shaft counteracts the spring-bias force on all but one of the four tube pinching arms, thereby allowing each of the four tube pinching arms, in succession, to temporarily succumb to the spring-bias force and rotate toward the pump shaft.

3. The ink supply pump of claim 1, wherein rotation of the cam shaft simultaneously allows each of the four tube pinching arms to succumb to the spring-bias force and rotate toward the pump shaft.

* * * * *